United States Patent [19]

Di Bernardo

[11] 4,164,111

[45] Aug. 14, 1979

[54] VACUUM-PACKING METHOD AND APPARATUS

[76] Inventor: Pietro Di Bernardo, via Falk 3, Milan, Italy

[21] Appl. No.: 852,578

[22] Filed: Nov. 17, 1977

[30] Foreign Application Priority Data

Nov. 19, 1976 [IT] Italy ..... 29595 A/76

[51] Int. Cl.[2] ..... B65B 31/02

[52] U.S. Cl. ..... 53/434; 53/441; 53/86; 53/512; 53/557

[58] Field of Search ..... 53/22 B, 22 A, 30 S, 53/86, 112 B, 112 A, 184 S

[56] References Cited

U.S. PATENT DOCUMENTS

| | | | |
|---|---|---|---|
| 3,777,446 | 12/1973 | Graver | 53/184 S X |
| 3,956,867 | 5/1976 | Utz et al. | 53/22 A |
| 3,958,391 | 5/1976 | Kujubu | 53/22 B |
| 3,991,543 | 11/1976 | Shaw | 53/86 X |

*Primary Examiner*—Travis S. McGehee

*Attorney, Agent, or Firm*—Holman & Stern

[57] ABSTRACT

In a vacuum-sealing method and apparatus for various articles to be packed under vacuum, the improvement consisting in that a hot-air circulating closed-loop path is provided within the vacuum-packaging enclosure, so as to have hot air circulating unidirectionally in order to sweep the package virtually concurrently with the evacuation and autogenous welding stage. A swingable flap valve inserted in the hot-air path upstream of the specially provided heating means ensures such a unidirectional hot air flow. By so doing, the vacuum-packing operations can be more efficiently and quickly completed. The package wrappers are made of a thermoplastics, heat-shrinkable material.

7 Claims, 3 Drawing Figures

VACUUM-PACKING METHOD AND APPARATUS

Figure 1:
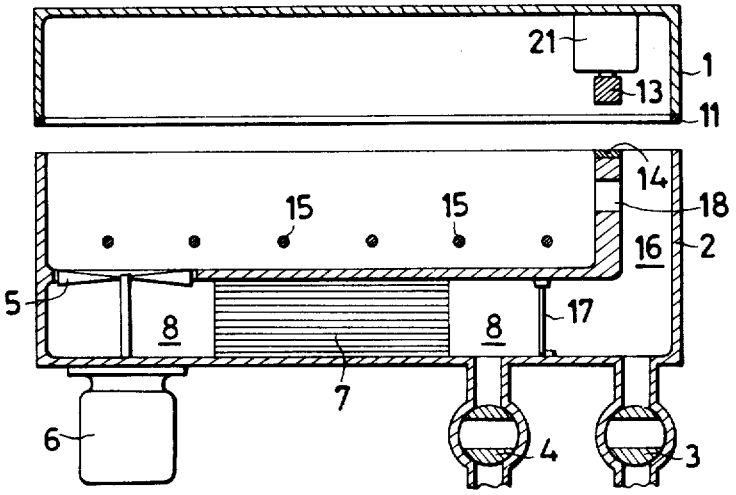

This invention relates to a method and an apparatus for vacuum-packing miscellaneous goods in thermoplastic material packagings and for the simultaneous heat treatment of the latter material.

Methods are known which comprise the steps of placing one or more products in the interior of a preshaped package, introducing the package assembly in a hermetically sealed enclosure, withdrawing air from the interior of the enclosure and thus concurrently from the interior of the package, permanently sealing the open end of the package by heat-welding or any other method and, after having restored in the interior of the enclosure the atmospherical pressure, opening the enclosure to remove the finished package. The vacuum-packs thus obtained are often subjected, in a subsequent step, to a heat treatment in specially provided ovens to order to melt-weld the inner surfaces of the used thermoplastic material over all the points in which they contact one another, or also in order to bring about the heat-shrinking of such material: by so doing, it becomes possible to have the material better adherent to the goods concerned and to improve the seal. The ovens which are used for this purpose are usually of the hot-air circulation type, combined with a continuously moving conveyor mechanism to forward the packed goods. The defect of such ovens is that they are considerably bulky and expensive. In addition, the dumping of the packet product takes place at a spot which is away of the station at which the enclosure operator stands for the vacuum-packing, so that an additional operator is required to discharge the product at the outlet end of the plant.

An object of the instant method is to make it possible to overcome the defects enumerated above by carrying out the heat-treatment in the very interior of the vacuum-enclosure and concurrently with the air-evacuation, package welding and atmospherical pressure restoring operations.

It is known that certain conventional plants afford the possibility of carrying out the heat-shrinking of a package placed in the interior of an enclosure, by forced circulation of hot air in the enclosure, hot air being drawn from a specially provided heat source. In such cases, however, no possibility had been provided for carrying out simultaneously the evacuation of the enclosure and the vacuum-sealing of the package. It has now been found, as will be detailed hereinafter, that these two steps can be coextensive. In practice, once a package has been placed in the enclosure and the latter has been closed, air evacuation is immediately started: even though the air grows progressively thinner, it is nevertheless sufficient, if heated to an appropriate temperature and caused to be forcibly circulated, to transfer congrous quantity of heat to the package, heat being derived from an appropriate source. It is likewise possible, in order that the transferred quantity of heat might be increased, to feed the enclosure anew with hot air under atmospherical pressures as soon as the welding cycle is started and until such times as the welding step has been completed: if so, such air can be heated by causing it to flow through the same heat source prior to feeding said air into the vacuum enclosure, or even by taking heat from an external source. Obviously, it is possible to extend the hot air flow also to the stage preceding the start of the evacuation, or to the stage which follows the completion of the welding operation, but in such cases the total duration of the vacuum-packing operation is longer. As a rule, these precautions are not always required. It is possible, moreover, to assist the action of hot air by the provision of infrared heating bodies arranged in the interior of the vacuum-enclosure.

The device which permits to reduce the instant method to practice is, under many respects, not dissimilar from the conventional ones. The device has as its basic component part an enclosure which can be opened in order to introduce thereinto one or more products which have been placed beforehand in their packaging wrappers, such as puches or bags, or sandwiched between previously provided films of a heat-sealable material. The open side(s) of the packaging is so arranged as to facilitate the action of the package-sealing mechanism. At a subsequent time, the enclosure is closed and air is removed by opening a communication valve connected to a vacuum-pump. The package-sealing mechanism is usually composed by two or more bars which are spaced apart from each other when in the at rest position. One or more bars can be heated so as to effect a heat-welding operation over the open side of the packaging. The autogeneous welding is obtained by actuating one bar which, being pushed against the other, causes the two flaps of the package in the sealing area to become squeezed therebetween. Autogenous welding thus takes place by the mere coaction of heat and pressure. A second valve then enables air under atmospherical pressure to be introduced into the enclosure. In addition to the conventional devices enumerated above, this invention provides for a system adapted to heat the air contained in the interior of the vacuum-enclosure, along with a system for causing the forced circulation of said air. Such a heat treatment, coacting with the atmospherical pressure, enables the sealing of the package to be effected also with cold bars and the latter, in this case, have a mere function of pressers. The heating device can be an electrically heated body which is so positioned as to have the forcibly circulated air sweeping thereover. Such heating body can be properly gilled so as to improve heat transfer. Usually, bodies having a high thermal inertia have given the best performance, but it is likewise possible to use exposed electric resistors made of a nickel-chromium alloy which can be energized only when necessary. The heating bodies can be in number of one or more and can be directly arranged within the vacuum-enclosure, or in a second chamber which can be connected to such enclosure either permanently or by operating a specially provided valve. If the resistors are arranged in a second chamber, the latter can be a suitable hot air storage room from which hot air can be drawn when appropriate. At any rate, it is necessary that a blower or any other equivalent contrivance ensures the circulation of air from the heating chamber to the vacuum-enclosure, and vice-versa.

The circulation of hot air can be effected before, or during, the evacuation stage, during autogenous welding and restoring the atmospherical pressure or also during a portion only of the latter stage: this can be obtained by merely stopping the blower or also by closing by the agency of a valve the communication between the heating chamber and the vacuum enclosure. The feeding of air for restoring the atmospherical pressure in the vacuum enclosure can also be effected by causing air first to flow through the heating chamber, or over the heating bodies, that which can be obtained by properly positioning the air feeding valve.

Figure 2:
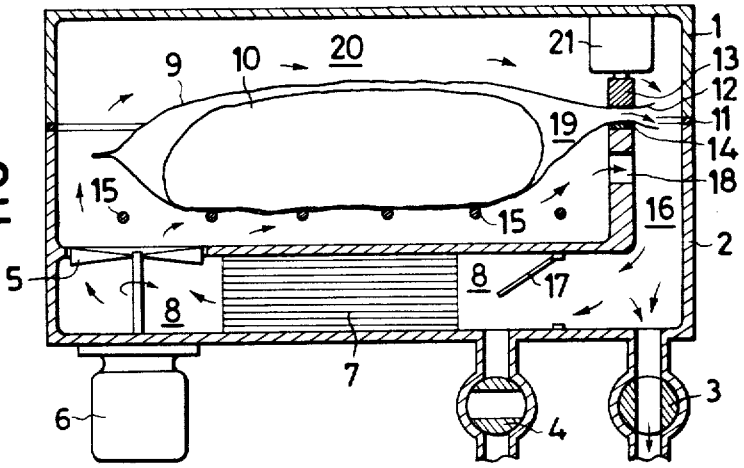
Figure 3:
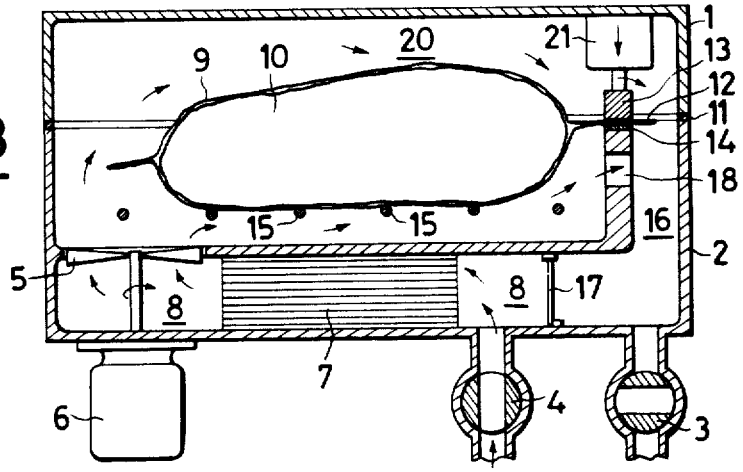

FIGS. 1, 2 and 3 diagrammatically show three longitudinal front elevational views, partly in cross-section, of an exemplary embodiment of the device of this invention, shown in three different stages of the vacuum-packaging cycle.

In FIG. 1, the two half-shells 1 and 2, which are the walls of the vacuum enclosure 20 are shown in explosion view and are spread apart from one another, so that the device is ready to receive one or more products. The valve 3 for communication with the vacuum-pump and the valve 4 for communication with the atmosphere are closed. The blower 5 and its driving motor 6 are motionless. The heating body 7 is continuously energized: it has a high thermal mass and is gilled so as to improve heat transfer. Under these conditions, the air in the space 8 (heating chamber) stores heat.

FIG. 2 illustrates the same device after that a package 9 containing a product 10 has been manually, or automatically, placed in the vacuum enclosure, the latter having been closed. The seal between the two half-shells of the enclosure is provided by a gasket 11. The open side of the package 12, is arranged between a top welding bar 13 and a bottom bar 14, which are conventional welding elements.

The top bar 13 is parallel to the bottom bar 14 and there is a gap therebetween which permits that air may be drawn from the interior of the package. The package rests on a few rods 15 which allow air to sweep also the bottom face of the package. As soon as the enclosure has been sealed, the blower 5, driven by the motor 6, starts its motion and conveys hot air from the chamber 8 to the interior of the vacuum enclosure 20. The air sweeps the outer surface of the package and then is brought back along the channel 16 to the chamber 8 and so forth. A swinging flap 17, the purpose of which will be illustrated hereinafter, is lifted by the air thrust so as to leave the passage free. The opening or gap 18 permits an easier circulation or air. Of course, also the air in the ecnlosure 20 is driven on and is, in its turn, heated by the heater 7. Concurrently with the sealing of the enclosure 20, or with a certain adjustable delay with respect to it, the valve 3 is opened and air is gradually drawn therethrough by a vacuum-pump, not shown. As the pressure of air in the enclosure is decreased, also the air contained in the package 19 is exhausted. Also the transfer of heat towards the package is gradually decreased due to the effect of air rarefaction so that very low values of heat transfer are attained. This notwithstanding, the welding of the package can be started and the atmospherical pressure restored in the enclosure 20 and the heating chamber 8.

This stage is shown in FIG. 3. It can be seen that the top bar 13 is pressed against the bottom bar 14 to start the welding step. The exact configuration of the bar 13 and its actuation device 21 are not shown since they are conventional. As soon as the open side 12 of the package 9 has been pinched between the bars 13 and 14, the suction valve 3 is closed while the valve 4 is concurrently opened, which permits the outside atmospherical air to enter. Meanwhile, due to the lack of an adequate thrust, the flap 17 was closed and air, by breaking through, is compelled to sweep the heater 7 prior to entering the enclosure 20. The blower 5 provides to the continuous circulation of air so that the heat treatment of the package can be proceeded with. On completion of the welding cycle, or at a subsequent stage, the blower 5 is stopped, the valve 4 is closed, the shell 1 of the enclosure is lifted and the bar 13 is brought back to its inoperative position. The package is thus finished and can be removed from the enclosure.

The packaged product could be removed also automatically if the rods 15 were appropriately driven or replaced by a suitable conveyor belt system. Such a possibility can be provided but it has not been shown in order not to overcrowd the drawings.

The device shown in FIGS. 1, 2 and 3 is but an example since the possible embodiments of this invention are countless.

For example, it is possible, instead of evacuating the entire enclosure, to restrict the evacuation to the interior of the package and this can be obtained, of course, by the agency of appropriate suction nozzles to be inserted through the open sides of the package. If so, it is possible to carry out the heat treatment by forced circulation of hot air during the evacuation of the package interior. It is obviously possible, moreover, to arrange in the interior of the wrapper a plurality of articles which, once the package has been sealed, will be separated from each other by severing the package.

I claim:

1. A method for packaging under vacuum a product inside a bag comprising the following steps:
   (a) arranging the bag made of heat-sealable material containing the product inside a treatment chamber that can be closed in an airtight manner;
   (b) closing said treatment chamber;
   (c) causing preheated hot air to circulate in said chamber under forced draft, said air being heated by means in said chamber;
   (d) evacuating said hot air to outside the chamber and thus outside the bag so as to create an environment under vacuum;
   (e) sealing the aperture of the bag;
   (f) re-establishing pressure in the treatment chamber by the introduction of outside air over the heating means thereby heating the introduced air; and
   (g) opening the chamber and removing the vacuum-packaged pack obtained.

2. A device for packaging under vacuum a product inside a bag made of heat sealable material comprising:
   an airtight-closable enclosure;
   a vacuum source;
   valve means for evacuating said enclosure connecting said vacuum source with said enclosure;
   means for hermetically sealing the bag operably mounted in said enclosure;
   air circulation means mounted in said enclosure for circulating the air in a loop in said enclosure over the bag;
   an air heater mounted in said enclosure between said valve means for evacuating and said air circulation means in said loop;
   valve means for admitting air into said enclosure between said valve means for evacuating and said air heater in said loop;
   unidirectional valve means in said loop between said valve means for evacuating and said valve means for admitting for limiting the air flow in said loop to travelling from the bag past the valve means for admitting through said air heater and back to the bag by action of said air circulation means.

3. A device according to claim 2, wherein said air heater has a high thermal inertia.

4. A device according to claim 2, wherein said means for circulating the air comprises a blower inserted in said loop.

5. A device according to claim 2, wherein means for sealing the bag comprises a heat-welding unit for the packages present in the chamber.

6. A device according to claim 2, further comprising a discontinuous resting surface in said enclosure for supporting the bag the whole package surface.

7. A device for packaging under vacuum a product inside a bag made of heat-sealable material having a mouth comprising:

an airtight-closable enclosure;

a vacuum source;

a conduit connecting said enclosure to said vacuum source;

a first valve in said conduit;

a bag heat-welding unit operatively mounted within said enclosure to seal the mouth of the bag;

an air blower mounted in said enclosure;

a divider wall dividing the interior volume of said enclosure into two portions, the first portion for containing the bag, the second portion forming an air flow loop from the mouth of the bag to said air blower to said first portion, said divider wall having an opening adjacent said heat welding unit to complete said loop, said conduit connecting into said second portion between said opening and said air blower;

an air heater mounted in said enclosure in said second portion between said conduit and said air blower;

a second valve connected to said enclosure into said second portion between said conduit and said air heater openable to atmosphere; and a unidirectional valve in said second portion between said conduit and said second valve limiting the air flow in said loop to one direction from the mouth of the bag and said opening past said conduit past said second valve through said air heater and into said first portion by action of said air blower.

* * * * *